United States Patent [19]

Sharma et al.

[11] Patent Number: 4,780,724

[45] Date of Patent: Oct. 25, 1988

[54] ANTENNA WITH INTEGRAL TUNING ELEMENT

[75] Inventors: Arvind K. Sharma, Cranbury, N.J.; Paul J. Stabile, Langhorne, Pa.

[73] Assignee: General Electric Company, Schenectady, N.Y.

[21] Appl. No.: 853,739

[22] Filed: Apr. 18, 1986

[51] Int. Cl.[4] ..... H01Q 1/38

[52] U.S. Cl. ..... 343/700 MS; 343/745; 333/104

[58] Field of Search ..... 343/700 MS, 745; 333/104

[56] References Cited

U.S. PATENT DOCUMENTS

| | | | |
|---|---|---|---|
| 3,416,042 | 12/1968 | Thomas et al. | 317/234 |
| 3,475,700 | 10/1969 | Ertel | 333/104 |
| 3,597,706 | 8/1971 | Kibler | 333/104 |
| 3,680,136 | 7/1972 | Collings | 343/746 |
| 3,909,751 | 9/1975 | Tang et al. | 333/104 |
| 4,053,895 | 10/1977 | Malagisi | 343/700 MS |
| 4,127,830 | 11/1978 | Chalijour et al. | 333/104 |
| 4,259,670 | 3/1981 | Schiavone | 343/700 MS |
| 4,322,695 | 3/1982 | Fleming et al. | 333/104 |
| 4,348,253 | 9/1982 | Subbarao et al. | 156/643 |
| 4,367,474 | 1/1983 | Schaubert et al. | 343/700 MS |
| 4,379,296 | 4/1983 | Farrar et al. | 343/700 MS |
| 4,382,261 | 5/1983 | Freibergs et al. | 343/854 |
| 4,475,108 | 10/1984 | Moser | 343/700 MS |
| 4,490,721 | 12/1984 | Stockton et al. | 343/368 |
| 4,491,977 | 1/1984 | Paul | 455/327 |
| 4,511,813 | 4/1985 | Pan | 333/104 |
| 4,529,987 | 7/1985 | Bhartia et al. | 343/700 MS |

OTHER PUBLICATIONS

Antenna Theory Analysis and Design, Constantine A. Balanis, 1982, p. 490.

An article entitled "Optical Control of Microwave PIN Diode and Its Applications", by Sykes et al. presented at the 1985 Benjamin Franklin Symposium in Philadelphia in May of 1985.

*Primary Examiner*—William L. Sikes

*Assistant Examiner*—Hoanganh Le

*Attorney, Agent, or Firm*—William I. Steckler; James C. Davis, Jr.; Paul R. Webb, II

[57] ABSTRACT

A patch antenna, which may be one element of an antenna array, is formed on one broad surface of a semiconductor plate. A ground plane is formed on the second broad surface. This semiconductor is doped in regions near a periphery of the patch to define a semiconductor PN junction have electrode contacts to the patch and to the ground plane. The junction has capacitance which tunes the patch antenna. The characteristics of the junction are controlled by bias to selectively tune the patch antenna. The bias is a direct voltage in one embodiment of the invention. In another embodiment, the junction work function itself provides a bias which is controlled by temperature control of the diode.

25 Claims, 7 Drawing Sheets

ANTENNA WITH INTEGRAL TUNING ELEMENT

This invention relates to antennas formed on semiconductor substrates with integral or monolithic tuning elements.

BACKGROUND OF THE INVENTION

Modern electromagnetic communication and remote sensing systems are using increasingly higher frequencies. High frequencies more readily accommodate the large bandwidths required by modern high data rate communications and such sensing arrangements as chirp radar. Also, at higher frequencies the physical size of an antenna required to produce a given amount of gain is smaller than at lower frequencies. Some high frequencies are particularly advantageous or disadvantageous because of the physical transmission properties of the atmosphere at the particular frequency. For example, communications are disadvantageous at 23 GHz because of the high path attenuation attributable to atmospheric water vapor, and at 55 GHz because of oxygen molecule absorption. On the other hand, frequencies near 40 GHz are particularly advantageous for communication and radar purposes in regions subject to smoke and dust because of the relatively low attenuation at those frequencies. When a high gain antenna array is required, it is advantageous for each antenna element of the array to have physically small dimensions in the arraying direction. For example, if it is desired to have a rectangular planar array of radiating elements for radiating in a direction normal or orthogonal to the plane of the array, it is desirable that the physical dimensions of each antenna element in the plane of the array be small so that they may be closely stacked. For those situations in which an antenna array uses a large number of radiating elements, it is also desirable that the radiating elements be substantially identical so that the radiation patterns attributable to each radiating element are identical.

It is difficult to generate large amounts of radio frequency (RF) energy at millimeter wave frequencies (frequencies in the range of roughly 30 to 300 GHz), and the losses attributable to transmission lines and other elements tend to be quite high at those frequencies. These considerations tend to reduce the power available for radiation by an antenna. Good engineering design, such as minimizing of transmission path lengths, can maximize the power available for radiation from an antenna. It may be desirable, however, to tune the antenna either to maximize radiated power or to allow the antenna to operate efficiently at various frequencies within an operating frequency range.

Antennas in the form of a rectangular conductive patch separated by a layer of dielectric material from a ground plane are known to provide certain advantages for millimeter wave operation, such as reasonable impedance match. Furthermore, such antennas are readily driven by strip transmission lines formed on the dielectric substrate. It is known to adjust the frequency and performance of such patch antennas, as described in U.S. Pat. No. 4,367,474 issued Jan. 4, 1983, in the name of Schaubert et al. The Schaubert arrangement describes the placing of conductive shorting posts in prepositioned holes extending between points on the patch antenna and a ground plane. Schaubert also describes the replacing of the conductive shorting posts by switching diodes which are coupled to the ground plane by bypass capacitors and which are also coupled to an external bias circuit by radio frequency chokes. Another prior art arrangement substitutes varactor or variable-capacitance diodes for the switching diodes, as described in U.S. Pat. 4,529,987 issued July 16, 1985, to Bhartia et al. At millimeter wave frequencies, the placement of the holes and of the connections of the diodes, and the necessary bias arrangements in the vicinity of the radiating portion of the antenna are subject to manufacturing tolerances which make it difficult to obtain reliable performance and which therefore increase the cost of manufacture of arrays which include multiple radiating elements. It is desirable to increase the reliability of performance of tuned antenna elements for reduction of cost of manufacture and for ease of arraying.

SUMMARY OF THE INVENTION

An antenna arrangement includes a planar substantially intrinsic semiconductor substrate which includes first and second broad sides. A first planar conductive element is attached to the first broad side of the substrate, and a second planar conductive element is attached to the second broad side of the substrate, and is shaped and dimensioned in conjunction with the shape and dimensions of the first planar conductive element for, when energized at a predetermined frequency, producing electromagnetic radiation in preferred directions. At least one semiconductor junction including first and second electrodes is formed within the substrate. The first electrode is galvanically or conductively connected to the first planar conductive element, and the second electrode of the semiconductor junction is conductively connected to the second planar conductive element. This electrically connects the semiconductor junction an its associated capacitance between the first and second planar conductive elements. A bias may be applied to the junction to adjust the capacitance of the junction for tuning at the predetermined frequency.

The bias may be supplied in a form of reverse bias voltage from a source of direct voltage, or the intrinsic reverse bias provided by the junction offset voltage may be variable by a thermal controller.

DESCRIPTION OF THE DRAWING

FIGS. 5*a* through 5*m* are various perspective views and cross-sections of a semiconductor substrate during the various steps of the processing required to produce the antenna illustrated in FIGS. 2*a* and 2*b;*

DETAILED DESCRIPTION OF THE INVENTION

Figure 1A:
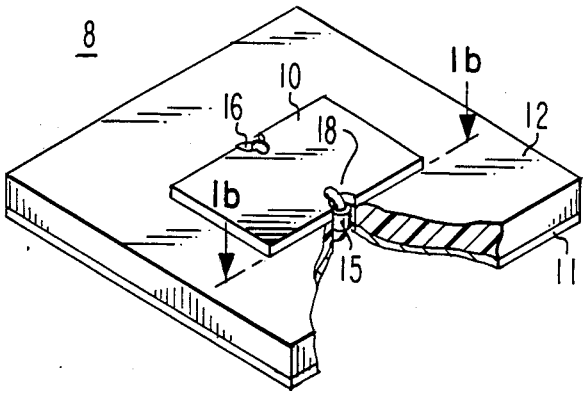
Fig. 1a PRIOR ART
FIG. 1*a* is a perspective view, partially cut away, of a patch antenna as in the prior art, together with its tuning diodes.
Figure 1B:
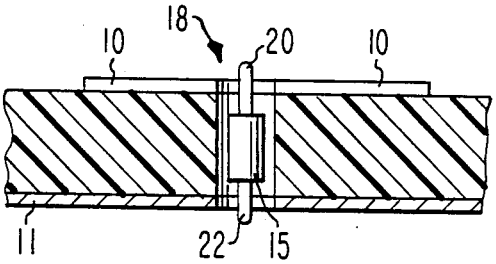
Fig. 1b PRIOR ART
FIG. 1*b* is a cross-sectional view of the prior art arrangement of FIG. 1*a;*

FIG. 1*a* illustrates a prior art patch antenna, generally as described in the aforementioned Bhartia et al. patent, cut away to illustrate the connections which must be made in such an arrangement. In FIG. 1*a*, an antenna designated generally as 8 in which the radiating element is a rectangular patch 10 of conductive material has patch 10 separated from a ground plane 11 by a thin dielectric layer 12. In accordance with the invention described by Bhartia et al., the bandwidth of the antenna is increased by the provision of a pair of varactor diodes, one of which is illustrated as 15, connected between the edges of patch 10 and ground plane 11. One way of implementing such an arrangement is to insert a discrete diode 15 having axial leads into a hole drilled or punched through dielectric plate 12 and ground plane 11 near the edge of patch 10. One such hole is illustrated as 16 in FIG. 1*a*, and the other hole through which diode 15 is inserted is partially cut away as viewed in FIG. 1*a* and is designated 18. FIG. 1*b* is a cross section of the arrangement of FIG. 1*a* looking in the direction 1*b*—1*b*. As illustrated in FIG. 1*b*, the axial leads 20, 22 of diode 15 extend through hole 18, and are bent to make contact with conductive patch 10 and with conductive ground plane 11, respectively. The leads may be soldered or welded to patch 10 and ground plane 11 as required to maintain good electrical contact.

An arrangement such as that illustrated in FIGS. 1*a* and 1*b* may be costly to manufacture. For example, when a plurality of conductive patches 10 are arrayed to form a multiple-antenna radiator, it is desirable that all the antennas have the same radiating characteristics and the same impedance characteristics. The radiating and impedance characteristics of the antenna, however, depend upon the net reactances of the varactor diodes such as diode 15, and the location of the diodes on the radiating patch. These reactances and positions depend not only upon the position of the drilled holes such as hole 18, but also upon the location and orientation of the diode (such as diode 15) within the hole it occupies, the diameters of the leads 20 and 22, and even upon the exact location on patch 10 at which lead 20 is attached. The net reactance also depends upon the capacitance of the various diodes under given bias conditions. If the diodes are not matched, their reactances under a particular bias condition will differ from one unit to another. It can be seen that great exactitude in the manufacturing process is required among the many antennas which may be used in an array, and in the selection of the appropriate diodes therefor.

Figure 2A:
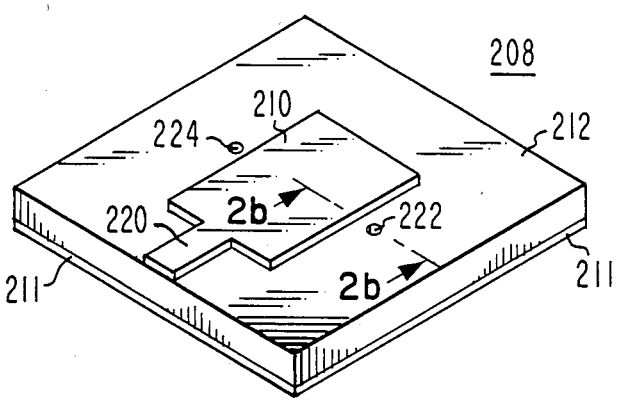
FIG. 2*a* is a perspective view of a patch antenna according to the invention.

FIG. 2*a* is a perspective view of an antenna 208 according to the invention. Antenna 208 includes a radiating element in the form of a rectangular conductive patch 210 separated from a conductive ground plane 211 by a thin semiconductor layer 212. In accordance with the invention, the bandwidth of the antenna is adjusted by the provision of one or more monolithic varactor diodes connected between various points on conductive patch 210 and ground plane 211. As illustrated in FIG. 2*a*, patch antenna 210 is coupled to a short portion of antenna feed microstrip line including an elongated conductive portion 220 spaced away from ground plane 211. Design of such microstrip transmission lines (sometimes known as strip lines) is well known and is not described herein. The locations of the two monolithic diodes in the arrangement of FIG. 2*a* is indicated, as described below, by the presence of via holes 222 and 224 near the edges of conductive patch 210.

Figure 2B:
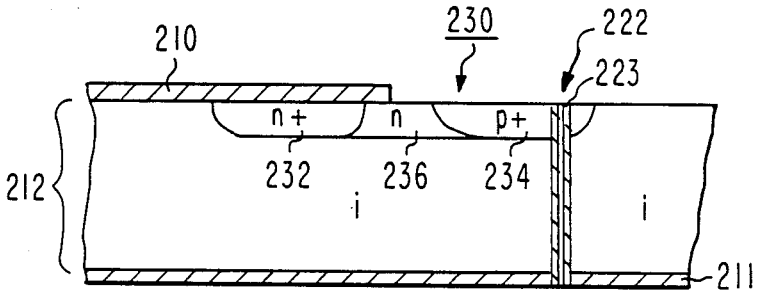
FIG. 2*b* is a cross section of the antenna of FIG. 2*a* in direction 2*a*—2*a*.

FIG. 2*b* is a cross section of a portion of the arrangement of FIG. 2*a* taken in the direction of arrows 2*b*—2*b*. In FIG. 2*b*, elements corresponding to those of FIG. 2*a* are designated by the same reference numerals. In FIG. 2*b*, conductive patch 210 is seen in cross section attached to an upper surface of semiconductor plate 212. Conductive ground plane 211 is attached to the bottom surface of semiconductor plate 212. The bulk of the semiconductor material is intrinsic (i). An intrinsic semiconductor (i) is one which is substantially pure, or which includes few impurities which affect its conductivity. Suitable semiconductors include silicon (Si) and gallium arsenide (GaAs). A transverse junction diode designated generally as 230 is formed near the upper surface of semiconductor plate 212 by a region 232 heavily doped with electron donor impurities (n+) so as to produce an ohmic contact area which is in intimate contact with conductive patch 210 so as to electrically connect conductive patch 210 to one electrode of junction diode 230. Another surface portion 234 is heavily doped with p donor impurities (p+) to form an ohmic contact with the conductive inner surface 223 of via hole 222. Via hole 222 and its conductive inner surface 223 extend all the way through plate 212 and ground plane 211. Thus, p+ doped region 234 is in conductive communication with ground plane 211. A third portion 236 of diode 230 is a region lightly doped with n donor impurities which, together with p+ region 234, forms the junction of junction diode 230.

Figure 2C:
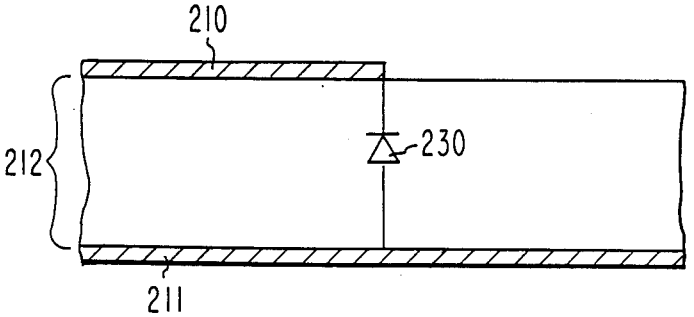
FIG. 2*c* is a cross-sectional view similar to FIG. 2*b* illustrating the equivalent circuit of the structure of FIG. 2*b;*
Figure 5A:
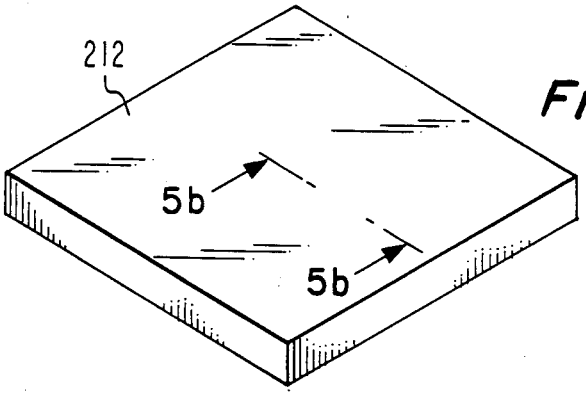
Figure 5B:
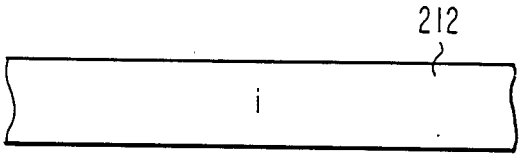
Figure 5C:
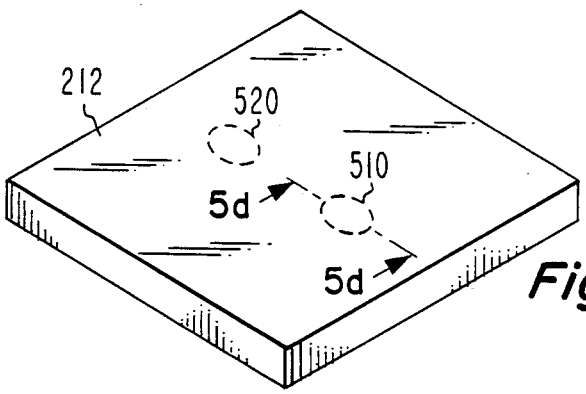
Figure 5D:
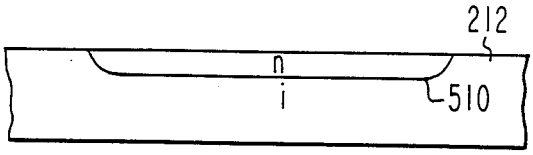
Figure 5E:
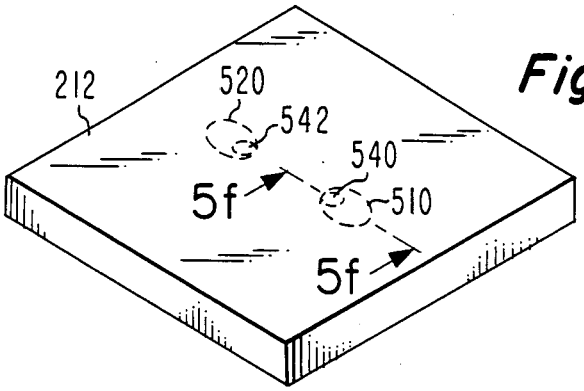
Figure 5F:
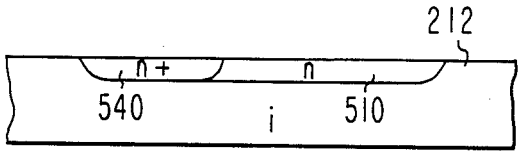
Figure 5G:
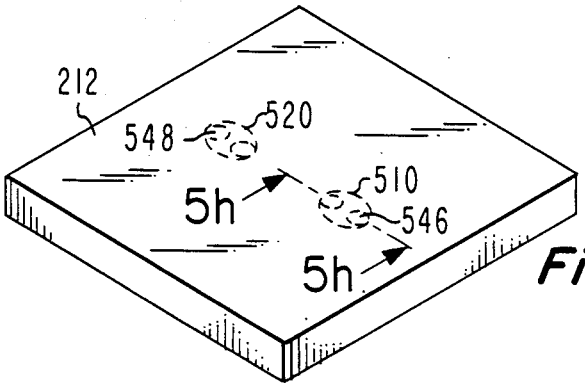
Figure 5H:
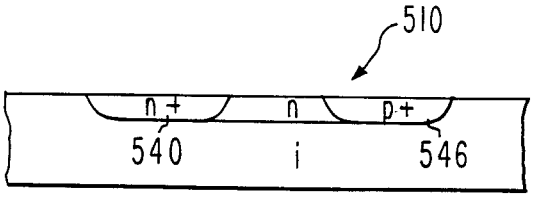
Figure 5I:
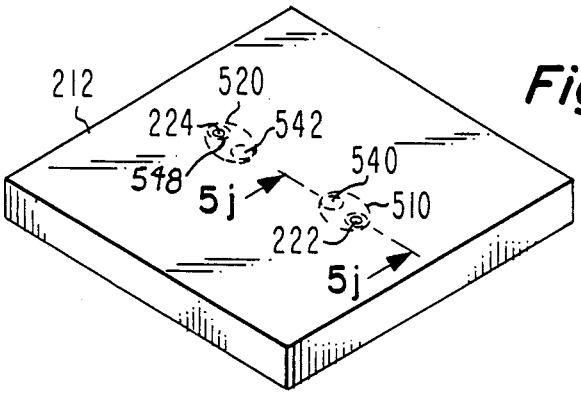
Figure 5J:
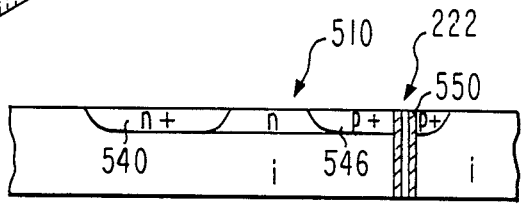
Figure 5K:
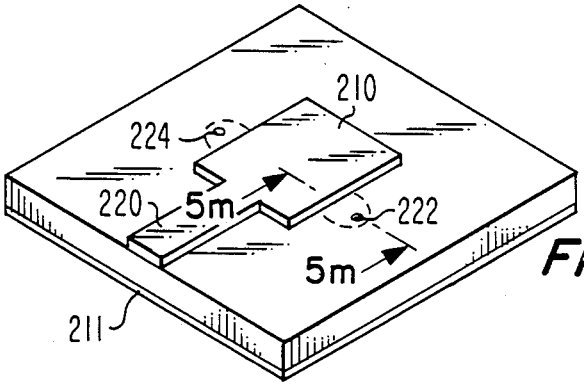
Figure 5M:
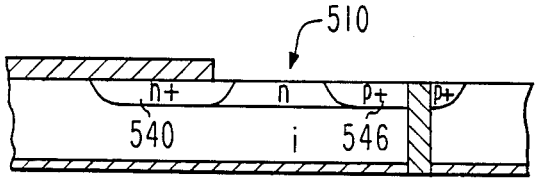

FIG. 2*c* is a cross section similar to that of FIG. 2*b* illustrating by a schematic diode symbol designated 230 the effective electrical circuit produced by the various dopings and connections illustrated in FIG. 2*b*.

Figure 3:
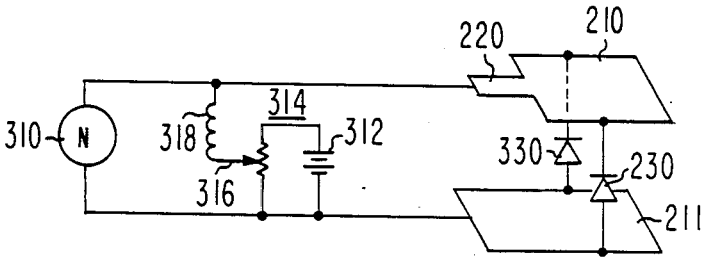
FIG. 3 is a diagram, partially in pictorial and partially in schematic form, illustrating the connections to the antenna illustrated in FIGS. 2*a* and 2*b* for radiating energy therefrom.

FIG. 3 illustrates, partially in pictorial and partially in schematic form, the electrical connections required to radiate signals from a tuned antenna according to the invention. Elements of FIG. 3 corresponding to elements of FIG. 2*a* are designated by the same reference number. In FIG. 3, a source 310 produces millimeter wave alternating (AC) signals which are applied by way of transmission line 220 to radiating patch 210 for producing electromagnetic radiation. As mentioned, the reactance of junction diode 230 and other diodes, one of which is illustrated as 330, affect the radiation. Both the antenna radiation pattern and the radiation efficiency at a particular frequency may be controlled by control of the bias of diodes 230 and 330. As illustrated in FIG. 3, the bias is a direct voltage having a polarity selected to reverse-bias the junction of the diodes. The reverse bias voltage is generated by a source of direct voltage illustrated as a battery 312 connected across a potentiometer 314 having a movable tap 316. Movement of tap 316 allows selection of any voltage up to the maximum voltage available from battery 312. Tap 316 is connected to transmission line 220 by means of a low pass filter illustrated as an inductor 318 which, as known, allows the direct bias voltage to be applied to transmission line 220 (and therefore by way of patch antenna 210 to diodes 230 and 330), but prevents or reduces leakage of millimeter wave signals from transmission line 220 into the source of bias voltage. Various types of low pass filters are known in the art and further explanation is deemed unnecessary. Adjustment of the position of tap 316 varies the reverse bias voltage across diodes 230 and 330, thereby changing their capacitance and adjusting the impedance and radiating characteristics of patch antenna 210.

Figure 4:
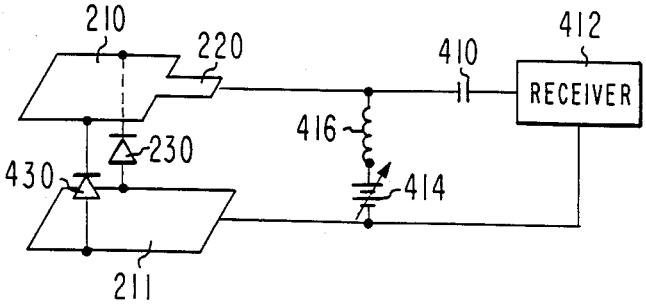
FIG. 4 is a diagram, partially in pictorial and partially in schematic form, illustrating the connections of the antenna of FIGS. 2*a* and 2*b* for use in receiving signals.

FIG. 4 illustrates, partially in pictorial and partially in schematic form, the electrical connections required to receive signals from a tuned antenna according to the invention. Elements of FIG. 4 corresponding to elements of FIG. *2a* are designated by the same reference numeral. In FIG. 4, antenna 210 receives millimeter wave signals which are coupled by way of transmission line 220 and by a direct current blocking capacitor 410 to a receiver illustrated as a block 412 which may downconvert the received signal, demodulate and perform other known receiver functions. A source of direct voltage bias includes a source of direct voltage illustrated as a variable battery 414 having its negative terminal electrically connected to ground plane 211 and its positive terminal connected by a low pass filter illustrated as an inductor 416 to transmission line 220. As the voltage produced by battery 414 is varied, the bias voltage applied by way of transmission line 220 and conductive patch 210 to reverse bias diodes 230 and 430 also varies. The impedance presented by radiating patch 210 to receiver 412, the gain and the receiving antenna pattern may be controlled by the bias voltage applied to diodes 230 and 430. It should be noted in this regard that it is well known that the receiving and transmitting functions of antennas are reciprocal, so that the gain, radiation pattern and impedance of a particular antenna are the same whether signal is transmitted or received. This reciprocity is often not stated, and discussion in the art is often couched only in terms of either transmission or reception.

FIGS. *5a–5m* illustrate various important steps in forming or manufacturing an antenna such as that illustrated in FIG. *2a*. FIG. *5a* is a perspective view of a portion of a semiconductor plate 212, and FIG. *5b* is a cross section of plate 212 in the direction of arrows *5b—5b*. The semiconductor material of which plate or substrate 212 is formed is substantially intrinsic and is so designated by the letter i. An intrinsic semiconductor is one without significant amounts of impurities which may affect its conductivity. The material may be silicon (Si) or gallium arsenide (GaAs) or any suitable semiconductor.

FIG. *5c* is a perspective view of plate 212 after the first step in processing, in which at two locations 510 and 520 illustrated by dotted outlines the surface region of the near side of plate 212 is lightly doped with electron donor impurities to form n regions. Region 530 is illustrated in cross section in FIG. *5b*, looking in the direction *5d—5d* of FIG. *5c*. The doping is performed by ion implantation in known manner, with an ion fluence or flux selected to yield the desired impurity concentration in the n region. A suitable impurity concentration for the n region is $5\times10^{15}$ atoms/cm$^3$. The thickness of n portion 530 may be, for example, 6 microns. In the case of a silicon (Si) substrate, a suitable n donor atom is phosphorus. For a gallium arsenide (GaAs) substrate, a suitable donor is silicon.

FIG. *5e* is a perspective view of semiconductor plate 212 of FIG. *5c* illustrating the locations 540, 542 within lightly doped regions 510 and 520, respectively, at which heavier n doping occurs. In region 510, location 540 is more heavily doped with n impurities, as illustrated in cross-sectional view taken along lines *5f—5f* in FIG. *5e*. The concentration of impurities in regions 540 and 542 is sufficiently high to define a conductive or ohmic contact with metal which is overlaid thereon at a later step of manufacture.

FIG. *5g* is a perspective view of semiconductor plate 212 illustrating the locations 546 and 548 within lightly doped region 510 and 520, respectively, which are heavily doped with p impurities (a p+ region). The doping of region 546 within region 510 and region 548 within region 520 with p impurities is at a concentration necessary to form a conductive contact with a metal layer formed during a later stage of manufacturing. The impurities may be boron (B) atoms when the substrate is silicon, and the impurity may be beryllium (Be) when the substrate is GaAs. FIG. *5h* is a cross section of plate 212 in a region near surface portion 510 looking in the direction of the arrows *5h—5h* of FIG. *5g*. As illustrated in FIG. *5h*, region 546 which is heavily doped with p impurities (and designated p+) does not completely fill lightly doped portion 510, and does not extend to, or come into contact with, n+ portion 540. Consequently, a semiconductor junction is set up between p+ region 546 and the n portion of surface region 510 not occupied by n+ region 540 or p+ region 546.

Following the manufacturing steps illustrated and described in conjunction with FIGS. *5g* and *5h*, the substrate is annealed in known fashion. Following the annealing, the via holes 222 and 224 are laser drilled through p+ regions 546 and 548, respectively. As described in U.S. Pat. 4,348,253 issued Sept. 7, 1982 to Subbarao et al., laser via holes may be drilled through the substrate. When the substrate is gallium arsenide, under some conditions a thin layer of metallic gallium illustrated as 550 forms on the inside surface of a laser drilled hole such as 222. The metallic gallium provides conductive contact through the length of hole 222.

FIG. *5k* illustrates semiconductor plate 212 with metallized regions added to form radiator patch 210, transmission line 220 and ground plane 211, and to completely fill in hole 222 with electroplated metal.

Figure 6:
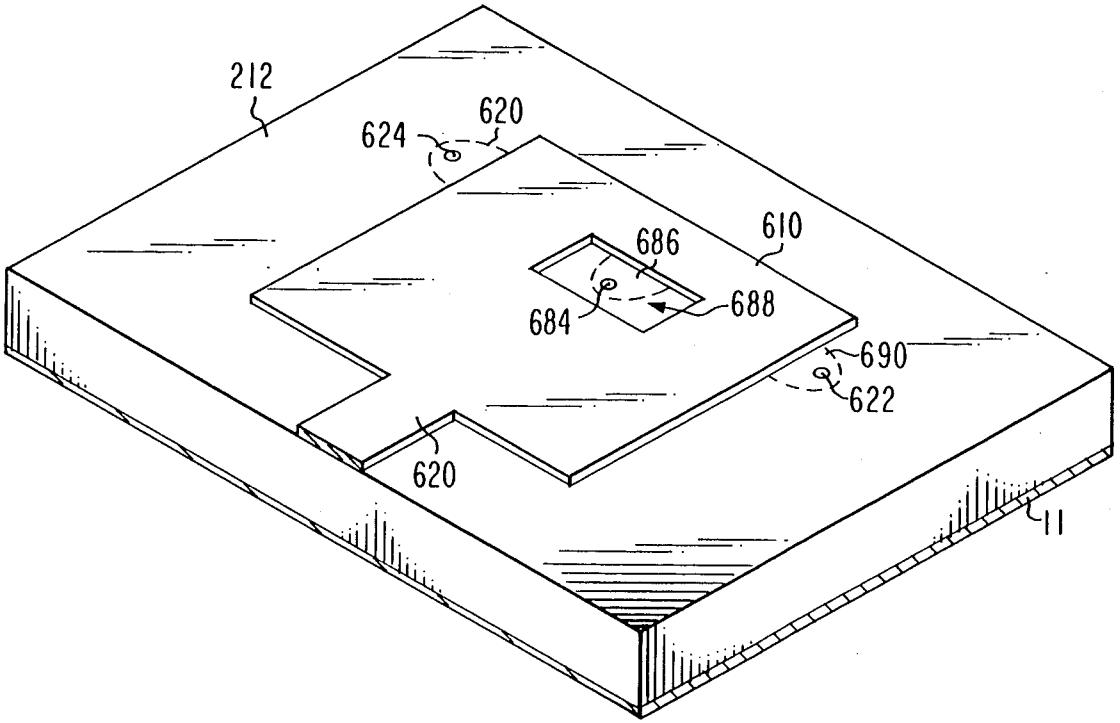
FIG. 6 illustrates how diodes can be connected to interior portions of an antenna for tuning at locations away from the edges.

FIG. 6 illustrates in perspective view a patch antenna 610 driven from a transmission line 620 arranged to provide tuning at locations other than along the periphery of the patch. As illustrated in FIG. 6, conductive patch 610 defines an aperture 688 having an inner periphery. This inner periphery allows formation of a further lateral diode in a region 686 which extends under the conductive portion of patch 610 for making conductive contact therewith, and which also extends to a via hole 684 for conductive contact with ground plane 11.

As so far described, the reactance of the junction diodes is controlled by the application of a reverse bias voltage. As known, a junction diode has an intrinsic offset voltage which may be approximately 0.3 volts for gallium arsenide and 0.7 volts for silicon. The bias voltage may be a forward bias voltage (as opposed to a reverse voltage) if desired in order to control the capacitance, so long as the forward bias voltage is less than the junction offset voltage That is, a forward bias voltage of less than approximately 0.3 volts in the case of gallium arsenide and less than approximately 0.7 volts in the case of silicon provides further control of the capacitance.

Figure 7:
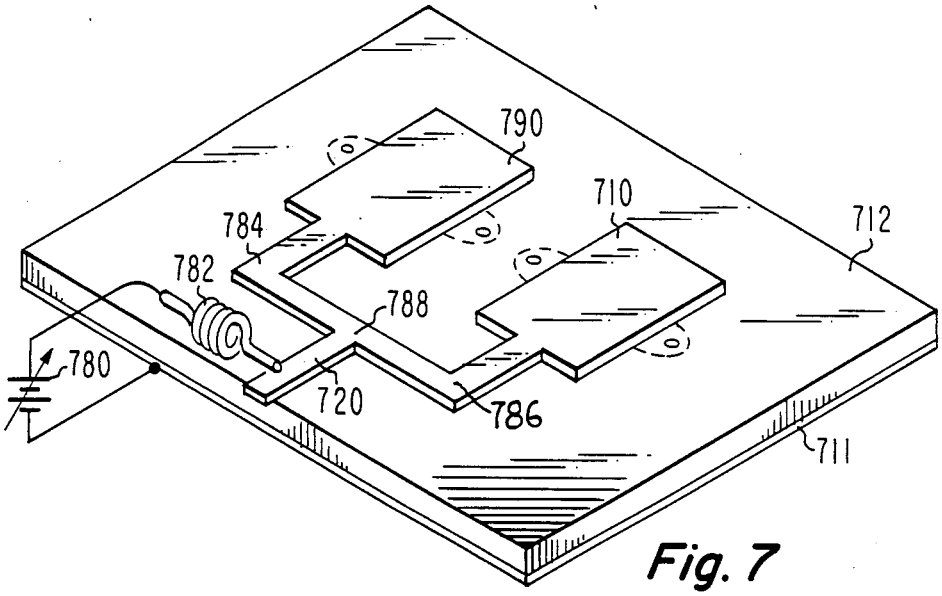
FIG. 7 illustrates the arraying of two patch antennas similar to the antennas illustrated in FIGS. 2*a* and 2*b*.

FIG. 7 illustrates an array 706 of two patch antennas 710, 790 driven in common or corporately from a strip conductor 720. A ground plane 711 is attached to the entire bottom side of semiconductor substrate 712. Strip conductor 720 in conjunction with ground plane 711 forms a transmission line having a characteristic impedance. Conductor 720 divides at a point 788 into two conductors 786 and 784, which couple power from conductor 720 to patch antennas 710 and 790, respectively. The lengths and widths of conductors 786 and 784 are selected in conjunction with the impedances of the patch antennas over the frequencies of operation to make the parallel impedance at the junction of conductors 786 and 784 a reasonable match to the impedance of the transmission line of which conductor 720 is a part. Perfect impedance match at all frequencies is seldom, if ever, achieved. All that is required is to have sufficient match to couple sufficient signal energy between conductor 720 and antennas 710, 790. A low pass filter represented as an inductor 782 is connected to common conductor 720 and to a source of direct voltage bias represented as a variable battery 780.

As known, phase shifters may be interposed between conductor 720 and one or both patch antennas 710, 790 for directing the peak of the radiation pattern of antenna array 706 in the desired direction. Alternatively, the relative impedances may be adjusted to provide the desired phase shift.

Figure 8:
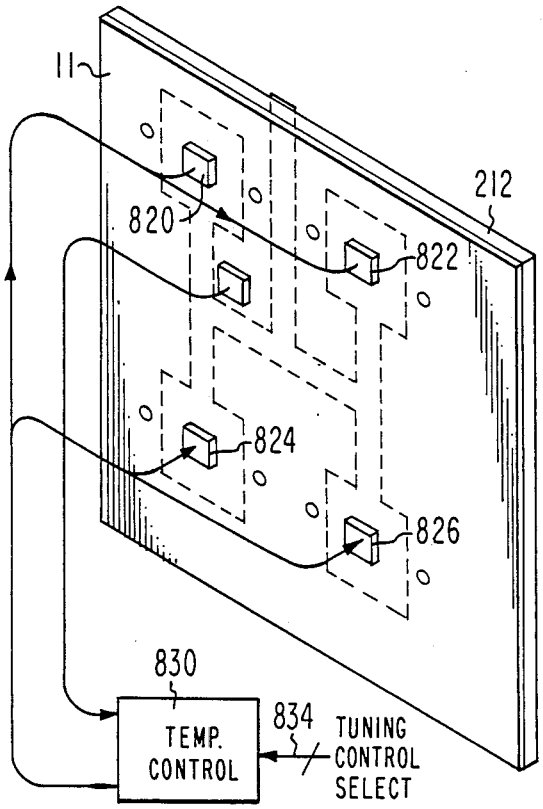
FIG. 8 illustrates, in pictorial and block diagram form, thermal control of antenna and junction diode temperatures.

It is also possible to change the inherent work function or junction offset voltage by control of the temperature of the junction diode. In effect, the diode self-bias is controlled by control of the diode temperature. FIG. 8 illustrates the back of a semiconductor plate 212, on the front of which is an array of four patch antennas and their feed transmission lines, all illustrated by dotted outlines. On the back of semiconductor plate 212 is a conductive ground plane 11 which faces the viewer in FIG. 8. Ground plane 11 prevents significant effect on the radiating pattern of the antennas or on their impedance due to objects placed on the ground plane on the side facing the viewer. As illustrated in FIG. 8, heating elements such as resistors 820, 822, 824 and 826 are affixed to ground plane 11 at locations selected for heating the junction diodes associated with the antenna elements. Resistors 820 through 826 are connected to a temperature controller illustrated as a block 830 which applies power to the resistors for causing them to dissipate power and thereby heat the adjacent portion of ground plane 11 and its associated structures. A temperature sensor illustrated as 832 is affixed to ground plane 11 at a location selected to indicate the average temperature of the substrate. Temperature sensor 832 is coupled to temperature controller 830 to provide a temperature indication thereto. A tuning control select conductor set 834 is coupled to controller 830 for providing to controller 830 an indication of the desired temperature to which ground plane 11 and substrate 212 are to be set. Temperature controller 830 compares the temperature indicated by sensor 832 with the setting selected by bus 834 and applies power to resistors 820, 822, 824 and 826 in known feedback manner in order to maintain the desired temperature. The temperature selected by bus 834 may be changed at will to change the temperature of ground plane 11 and substrate 212 to thereby change the temperature of the junction diode(s) formed in substrate 212 and thereby change the capacitance characteristics of the junction to effect the desired tuning.

Other embodiments of the invention will be apparent to those skilled in the art. For example, each diode may be associated with more than one via hole for reduced inductive reactance. Any desired biasing method may be used for changing the capacitance of the tuning diodes, as for example self-rectification of the applied RF signal voltage to produce a direct voltage bias. A direct current bias may be used. A plurality of tuning diodes may be located along one or more of the sides of the conductive portion of the antenna. Rather than an unbalanced radiating configuration including a discrete radiator and a conductive ground plane, a balanced or bilateral radiator configuration may be used, with the diode or diodes connecting between the two halves of the balanced configuration. Such a balanced configuration might be, for example, a dipole element. The two halves of the balanced configuration may be on opposite sides or on the same side of the substrate. The patch antenna may have regular geometric shapes other than rectangular, such as circular, disc or ring, triangular, polygonal, and elliptical.

What is claimed is:

1. An antenna arrangement, comprising:

a planar substantially intrinsic semiconductor substrate including first and second broad sides;

a first planar conductive element attached to said first broad side of said substrate;

a second planar conductive element attached to said second broad side of said substrate; and at least one semiconductor P-N diode having associated capacitance and including first and second adjacent electrodes of opposite conductivity type formed within said substrate, said first electrode being galvanically connected to said first planar conductive element, and said second electrode being glavanically connected to said second planar conductive element for electrically connecting said diode between said first and secondf planar conductive elements.

2. An arrangement according to claim 1 wherein said first planar conductive element is a rectangular patch and said second planar conductive element is a groound plane.

3. An arrangement according to claim 1 further comprising biasing means coupled to said diode for controlling said capacitance.

4. An arrangement according to claim 3 wherein said biasing means comprises a source of direct voltage.

5. An arrangement according to claim 1 further comprising an elongated planar conductive element attached to said first broad side of said substrate, one end of said elongated planar conductive element being electrically continuous with said first planar conductive element, said elongated planar conductive element coacting with said second planar conductive element to define a transmission line.

6. An arrangement according to claim 5 further comprising biasing means coupled to said diode for controlling said capacitance.

7. An arrangement according to claim 6 wherein said biasing means comprises:

a source of direct voltage; and low pass filter means coupled to said source of direct voltage and to a point along said elongated planar conductive element for coupling said direct voltage from said source of direct voltage to said diode by way of said elongated planar conductive element and first planar conductive elements, and for preventing significant amounts of signal from leaking from said elongated planar conductive element to said source of direct voltage.

8. An antenna array, comprising:

a planar substantially intrinsic semiconductor substrate including first and second broad sides;

at least first and second separated planar conductive elements attached to said first broad side of said substrate;;

a third planar conductive element attached to said second broad side of said substrate; and at least first and second semiconductor P-N diodes, formed within said substrate, each of said first and second semiconductor diodes having associated capacitance and including first and second adjacent electrodes of opposite conductivity type, said first electrodes of said first and second semiconductor diodes being galvanically connected to said first and second planar conductive elements, respectively, and said second electrodes of said first and second semiconductor diodes being galvanically connected at different locations to said third planar conductive element for electrically connecting said first semiconductor diode between said first and third planar conductive elements and for electrically connecting said second semiconductor diode betwen said second and third planar conductive elements.

9. An array according to claim 8 wherein said first and second planar conductive elements are rectangular patches, and said third planar conductive element is a ground plane.

10. An array according to claim 8 wherein said first semiconductor diode comprises:

a doped surface portion near the surface of said first broad side of said planar substantially intrinsic semiconductor substrate, said doped surface portion including a first region which is heavily doped with one of n and p impurities, said first region lying under and being in contact with said first planar conductive element for forming an ohmic contact between said first planar conductive element and said doped surface portion;

a conductive via hole extending between said first and second broad sides of said planar substantially intrinsic semiconductor substrate in a second region of said doped surface portion, said second region being heavily doped with the other of said n and p impurities for forming an ohmic contact between said doped surface portion and said via hole, thereby creating said semiconductor diode as a transverse diode in said doped surface portion.

11. An array according to claim 8, comprising:

first and second elongated planar conductive elements attached to said first broad side of said substrate, one end of each of said first and second elongated planar conductive elements being continuous with said first and second separated planar conductive elements, respectively, for coacting with said third planar conductive element for defining feed transmission lines for said first and second separated planar conductive elements, the other end of each of said first and second elongated planar conductive elements being electrically coupled for corporate feed of said first and second separated conductive elements.

12. An array according to claim 11 further comprising bias means coupled to said first and second semiconductor diodes for controlling said capacitance.

13. An array according to claim 12 wherein said bias means comprises a source of direct voltage.

14. An array according to claim 13 further comprising low pass filter means coupled to said source of direct voltage and to said corporate feed.

15. An antenna arrangement, comprising:

a planar substantially intrinsic semiconductor substrate including first and second broad sides;

a first planar conductive element attached to said first broad side of said substrate;

a second planar conductive element attached to said second broad side of said substrate;

at least one semiconductor P-N diode having associated capacitance and including first and second adjacent electrodes of opposite conductivity type formed within said substrate, said first electrode being galvanically connected to said first planar conductive element, and said second electrode being galvanically connected to said second planar conductive element for electrically connecting said diode between said first and second planar conductive elements;

wherein said semiconductor diode comprises a doped surface portion near the surface of said first broad side of said planar substantially intrinsic semiconductor suhbstrate, said doped surface portion including a first region which is heavily doped with one of n and p impurities, said first region lying under and being in contact with said first planar conductive element for forming an ohmic contact between said first planar conductive element and said doped surface portion; and a conductive via hole extending between said first and second broad sides of said planar substantially intrinsic semiconductor substrate in a second region of said doped surface portion, said second region being heavily doped with the other of said n and p impurities for forming an ohmic contact between said doped surface portion and said via hole, thereby creating said semiconductor diode as a transverse diode in said doped surface portion.

16. An arrangement according to claim 15 wherein said first planar conductive element is a rectangular patch and said second planar conductive element is a ground plane.

17. An arrangement according to claim 15 wherein said one of said n and p is n.

18. An arrangement according to claim 17 wherein said semiconductor substrate is silicon, said n impurities are phosphorus ions and said p impurities are boron ions.

19. An arrangement according to claim 17 wherein said semiconductor substrate is gallium arsenide, said n impurities are silicon ions, and said p impurities are beryllium ions.

20. An arrangement according to claim 24 wherein said via hole has a conductive surface region formed from metallic gallium.

21. An arrangement according to claim 15 further comprising biasing means coupled to said diode for controlling said capacitance.

22. An arrangement according to claim 21 wherein said biasing means comprises a source of direct voltage.

23. An arrangement according to claim 15 further comprising an elongated planar conductive element attached to said first broad side of said substrate, one end of said elongated planar conductive element being electrically continuous with said first planar conductive element, said elongated planar conductive element coacting with said second planar conductive element to define a transmission line.

24. An arrangement according to claim 23 further comprising biasing means coupled to said diode for controlling said capacitance.

25. An arrangement according to claim 24 wherein said biasing means comprises:

a source of direct voltage; and low pass filter means coupled to said source of direct voltage and to a point along said elongated planar conductive element for coupling said direct voltage from said source of direct voltage to said diode by way of said elongated planar conductive element said first planar conductive elements, and for preventing significant amounts of signal from leaking from said elongated planar conductive element to said source of direct voltage.

* * * * *